US011404832B2

(12) United States Patent
Wiebe et al.

(10) Patent No.: US 11,404,832 B2
(45) Date of Patent: Aug. 2, 2022

(54) CONNECTOR ASSEMBLY FOR ELECTRICALLY CONNECTING TWO CABLES

(71) Applicant: MD ELEKTRONIK GmbH, Waldkraiburg (DE)

(72) Inventors: Rudolf Wiebe, Kraiburg am Inn (DE); Johannes Eben, Schechen (DE); Stefan Sperr, Reichertsheim (DE); Josef Ohni, Kraiburg am Inn (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 17/170,909

(22) Filed: Feb. 9, 2021

(65) Prior Publication Data

US 2021/0281023 A1 Sep. 9, 2021

(30) Foreign Application Priority Data

Mar. 9, 2020 (DE) ..... 10 2020 106 243.5

(51) Int. Cl.

| | |
|---|---|
| ***H01R 24/38*** | (2011.01) |
| ***H01R 13/24*** | (2006.01) |
| ***H01R 13/502*** | (2006.01) |
| ***H01R 13/6581*** | (2011.01) |

(52) U.S. Cl.

CPC ..... *H01R 24/38* (2013.01); *H01R 13/2478* (2013.01); *H01R 13/502* (2013.01); *H01R 13/6581* (2013.01)

(58) Field of Classification Search

CPC .. H01R 24/38; H01R 13/2478; H01R 13/502; H01R 13/6581

USPC ..... 439/578

See application file for complete search history.

(56) References Cited

U.S. PATENT DOCUMENTS

| | | | | |
|---|---|---|---|---|
| 9,039,424 | B2 * | 5/2015 | Camelio | H01R 24/50 439/63 |
| 2014/0227905 | A1 | 8/2014 | Knott et al. | |

FOREIGN PATENT DOCUMENTS

| | | | | |
|---|---|---|---|---|
| DE | 102018208532 | A1 | 12/2019 | |
| EP | 0006343 | A1 | 1/1980 | |
| EP | 0122700 | A2 | 10/1984 | |
| EP | 3460916 | A1 * | 3/2019 | H01R 11/28 |
| EP | 3460916 | A1 | 3/2019 | |
| EP | 3487007 | A2 * | 5/2019 | H01R 13/405 |
| EP | 3726667 | A1 | 10/2020 | |

(Continued)

*Primary Examiner* — Peter G Leigh

(74) *Attorney, Agent, or Firm* — Leydig, Voit & Mayer Ltd.

(57) ABSTRACT

A connector assembly for connecting a cable to an electrical component includes a plug unit and a mating plug unit, which each have an outer conductor element, an insulator element and an inner conductor element. The insulator element is disposed within the outer conductor element and includes an inner conductor channel in which the inner conductor element is disposed. The insulator element of the plug unit forms a plug profile that extends around the inner conductor channel and has at least one projection and/or depression. The insulator element of the mating plug unit forms a mating plug profile that corresponds to a negative of the plug profile. The plug unit and the mating plug unit are connectable to one another in such a way that the plug profile and the mating plug profile rest against each other, at least in some areas.

13 Claims, 2 Drawing Sheets

(56) References Cited

FOREIGN PATENT DOCUMENTS

| | | | | |
|---|---|---|---|---|
| EP | 3772141 | A1 | 2/2021 | |
| WO | WO-2013059574 | A1 * | 4/2013 | ..... H01R 24/50 |

* cited by examiner

CONNECTOR ASSEMBLY FOR ELECTRICALLY CONNECTING TWO CABLES

CROSS-REFERENCE TO PRIOR APPLICATIONS

Priority is claimed to German Patent Application No. DE 10 2020 106 243.5, filed on Mar. 9, 2020, the entire disclosure of which is hereby incorporated by reference herein.

FIELD

The invention relates to a connector assembly for releasably connecting electrical cables, in particular radio-frequency cables, to an electrical component.

BACKGROUND

Today, due to the increasing digitization of components and systems and the associated increasing amount of data to be transmitted, increasingly higher demands are being placed on the cables required for transmission. In particular, a constantly high signal transmission quality over large frequency ranges combined with low, or at least constant attenuation over the respective frequency range plays an increasingly central role.

In order to meet these requirements, use is made of radio-frequency cables, such as coaxial cables. The coaxial arrangement of the inner conductor, the dielectric, and the shield largely ensures high signal transmission quality combined with low attenuation and low susceptibility to interference, provided the coaxial configuration and the associated characteristic impedance are maintained substantially constant over the entire length of the electrical cable. However, the cable ends, on which typically connector systems are mounted to electrically conductively and communicatively connect the cable to the components or other cables between which data is to be transmitted, are problematic in this context.

However, such connector systems, which may be in the form of a plug-and-socket connector, have the disadvantage that it is very difficult to achieve a constant characteristic impedance, especially at the junction point, because of an air gap which remains at the junction point between the two connection partners, for example, due to tolerances, and which may adversely affect the return loss and thus the transmission quality. Nevertheless, at the same time, the connector system must have a geometry that minimizes the risk of damage to the often very delicate cable ends during the connection process or during normal operation of the cable.

SUMMARY

In an embodiment, the present invention provides a connector assembly for connecting a cable to an electrical component. The connector assembly includes a plug unit having a first plug end, and a mating plug unit having a second plug end. The mating plug unit is connectable to the plug unit. The plug unit and the mating plug unit each have an outer conductor element, an insulator element and an inner conductor element. The insulator element is in each case disposed within the outer conductor element and includes an inner conductor channel in which the inner conductor element is disposed. The insulator element of the plug unit forms, at least partially, a plug profile at an end facing toward the first plug end, the plug profile extending at least partially around the inner conductor channel of the plug unit and having at least one projection and/or depression. The insulator element of the mating plug unit forms, at least partially, a mating plug profile at an end facing toward the second plug end, the mating plug profile at least partially corresponding to a negative of the plug profile. The plug unit and the mating plug unit are connectable to one another in such a way that the plug profile and the mating plug profile rest against each other, at least in some areas.

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1:
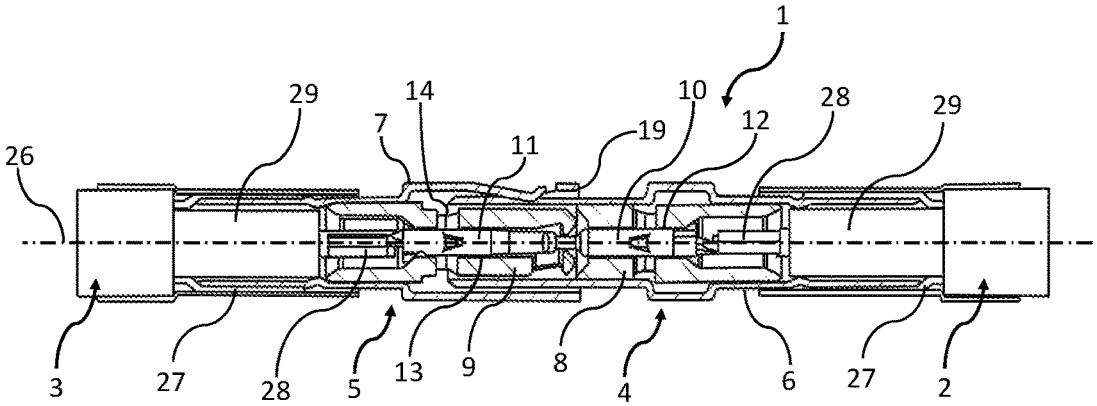
FIG. 1 is a sectional view of a first embodiment of a connector assembly according to the invention.

Embodiments of the present invention overcome at least one of the disadvantages of the above-mentioned prior art and produce a releasable connector assembly for connecting cables, in particular radio-frequency cables, to an electrical component, such as another cable or a semiconductor circuit board, where the transmission quality of the signals to be transmitted is impaired to the least extent possible.

A connector assembly according to an embodiment of the invention is suitable for connecting a cable to an electrical component. In this context, an electrical component may be understood to be, for example, a semiconductor circuit board or another cable to which the cable is to be connected. The inventive connector assembly includes a plug unit. The plug unit is electrically conductively and preferably permanently connectable to the cable or to the electrical component and has an outer conductor element, an insulator element, and an inner conductor element. The connector assembly further includes a mating plug unit, which is electrically conductively and preferably releasably connectable to the plug unit. The mating plug unit is electrically conductively and preferably permanently connected to the electrical component or cable that is to be connected to the plug unit. The mating plug unit also includes an outer conductor element, an insulator element, and an inner conductor element.

The insulator element of the plug unit is disposed within the outer conductor element of the plug unit. The insulator element of the plug unit has an inner conductor channel in which is disposed the inner conductor element of the plug unit. In this context, an inner conductor channel may be understood to be a tubular passage in the insulator element. The mating plug unit has a comparable arrangement of outer conductor element, insulator element, and inner conductor element. Thus, the insulator element of the mating plug unit also has an inner conductor channel. A configuration as described may be implemented, for example, by the outer conductor elements of the plug unit and the mating plug unit being formed as a sleeve in which is disposed the, preferably cylindrical, insulator element. The inner conductor element is disposed in the inner conductor channel of the insulator element. The longitudinal axes of the inner conductor element, the outer conductor element, and the insulator element preferably extend in parallel, and preferably so in both the plug unit and the mating plug unit. It is especially preferred that in both the plug unit and the mating plug unit, the inner conductor channel be disposed, in particular centrally, on the longitudinal axis of the insulator element. Most preferred, however, is a coaxial arrangement of the inner conductor element, the outer conductor element, and the insulator element in both the plug unit and the mating plug unit.

The plug unit has a first plug end. In this context, the first plug end may be understood to be the end of the plug unit where the plug unit is, preferably releasably, connectable to the mating plug unit. The insulator element of the plug unit forms, at least partially, a plug profile at an end facing toward the plug end. Particularly preferably, the plug profile is disposed on the end face of the insulator element of the plug unit which end face faces toward the first plug end. The plug profile extends at least partially around the inner conductor channel and has at least one projection and/or depression. It is also possible that the plug profile may have a plurality of projections and depressions or a combination of one or more projections and one or more depressions. The projections and/or depressions preferably extend parallel to the longitudinal axis of the insulator element of the plug unit. Furthermore, the plug profile is preferably disposed annularly around the inner conductor channel and may be either spaced apart from the inner conductor channel or adjacent to the inner conductor channel.

The mating plug unit has a second plug end. In this context, the second plug end may be understood to be the end of the mating plug unit with which the mating plug unit is, preferably releasably, connectable to the plug unit. The insulator element of the mating plug unit forms, at least partially, a mating plug profile at an end facing toward the second plug end. Preferably, the mating plug profile is disposed on an end face of the insulator element of the mating plug unit. The mating plug profile preferably also extends at least partially around the inner conductor channel of the insulator element of the mating plug unit and may be annular in shape. The mating plug profile at least partially corresponds to a negative of the plug profile.

The plug unit and the mating plug unit are connectable to one another in such a way that the plug profile and the mating plug profile rest against each other, at least in some areas. The connection can be made, for example, by the outer conductor elements of the plug unit and the mating plug unit being inserted into one another with the facing first and second plug ends, and the inner conductor elements of the plug unit and the mating plug unit becoming electrically conductively connected to each other.

The connector assembly according to an embodiment of the invention provides a connection option, in particular for radio-frequency cables, which makes it possible to ensure a comparatively high signal quality. This is mainly due to the engagement of the plug profile into the mating plug profile. Even in the case of large tolerance variations, it is thus ensured that no continuous air gap can form between the two insulator elements and up to the outer conductor. Thus, variations in the characteristic impedance and associated variations in the signal quality can be kept low even in the case of tolerance variations.

It may be advantageous if the plug profile is partially formed by the inner conductor element of the plug unit. Thus, a portion of the plug profile may be formed by the insulator element and another portion of the plug profile may be formed by the inner conductor element of the plug unit. This allows the mating plug profile to be positioned not only particularly close to the insulator element of the plug unit, but also at a minimum possible distance from the inner conductor element of the plug unit when the plug unit and the mating plug unit are connected together. The mating plug profile may also be partially formed by the inner conductor element of the mating plug unit.

In this context, it may be advantageous if the inner conductor element of the plug unit and/or of the mating plug unit have/has a profiled portion in the region of the plug profile. Within the profiled portion, the inner conductor element may have a specific shape that allows the plug profile and the mating plug profile to rest against one another with their contours in particularly close proximity. It has been found that a conical, parabolic and/or bulbous shape is particularly suitable. If the inner conductor element is a contact tip, it has been found to be particularly advantageous if the inner conductor element tapers in the profiled portion toward the plug end. If the inner conductor element is a contact socket, it has been found to be advantageous if the inner conductor element widens in the profiled portion toward the plug end. Particularly preferably, the shape of the profiled portion is rotationally symmetric about a central axis of the inner conductor element.

The plug profile and/or the mating plug profile may have a bevel extending at least partially around the circumference of the inner conductor channel of the respective insulator element. The bevel may be formed both on a projection and on a depression of the plug profile and/or of the mating plug profile. The bevel may be formed on a side of the projection and/or depression that faces toward and/or away from the inner conductor channel. The bevel may have an angle of, for example, 20 to 70 degrees. If the bevel extends around the entire circumference of the inner conductor, two opposite bevels may form an angle of from 40 to 140 degrees therebetween. Owing to the bevel, the plug profile and/or the mating plug profile can be used as a guide during the connection process, thereby ensuring that all components are reliably and electrically conductively connected together even when the plug unit and the mating plug unit are inserted obliquely into one another. The bevel may also be formed on an outer edge of the insulator element of the plug unit or of the mating plug unit. In this case, the bevel is particularly preferably formed on an outer edge of the end face of the insulator element of the plug unit and/or of the mating plug unit which end face faces toward the respective plug end.

The inner conductor element of the plug unit may include a first contacting portion projecting from the insulator element toward the first plug end. If the inner conductor element has a profiled portion, it is preferred that the first contacting portion adjoin the profiled portion. The contacting portion may be in the form of a contact tip and have a length of from 2.5 to 5 millimeters. Furthermore, the first contacting portion may have a smallest diameter of the inner conductor element.

The first contacting portion may be insertable into the inner conductor channel of the insulator element of the mating plug unit and electrically conductively connectable to a second contacting portion of the inner conductor element of the mating plug unit. If the first contacting portion is in the form of a contact tip, it is advantageous here if the second contacting portion is in the form of a contact socket. It may be particularly advantageous if an electrically conductive connection between the first and second contacting portions cannot be created until within the inner conductor channel of the insulator element of the mating plug unit.

The inner conductor element of the mating plug unit may be set back from the end of the insulator element of the mating plug unit which end faces toward the second plug end. In this case, the inner conductor element of the plug unit is initially inserted into the inner conductor channel of the inner conductor element of the mating plug unit before the inner conductor element of the plug unit is electrically conductively connected to the inner conductor element of the mating plug unit. The inner conductor element of the mating plug unit may be set back by a distance of from 0.4 to 1.2 millimeters from the end face of the end of the insulator element that faces toward the second plug end.

The insulator element of the mating plug unit may have a funnel shape in the region of the inner conductor channel at the end facing toward the second plug end. The funnel shape may serve as a guide to ensure that the inner conductor elements of the plug unit and the mating plug unit are electrically conductively connected as the plug unit and the mating plug unit are connected together. The funnel shape is advantageous, particularly when the inner conductor element must first be inserted into the inner conductor channel of the insulator element of the mating plug unit in order to be electrically conductively connected to the inner conductor element of the mating plug unit. Preferably, the funnel shape is circular, and the center of the funnel shape may be located on the longitudinal axis of the insulator element.

Furthermore, the funnel shape may at least partially form the mating plug profile. The funnel shape may have both linear and curved side walls. It is further preferred that the funnel shape at least partially correspond to the negative of the inner conductor element of the plug unit in the region of the plug profile. In a particularly preferred embodiment, in addition to the funnel shape, the insulator element has a circumferential bevel on an outer edge, the circumferential bevel at least partially forming the mating plug profile.

The plug profile or the mating plug profile may have an annular depression around the circumference of the inner conductor element. The center of the annular depression is particularly preferably located on the longitudinal axis of the inner conductor channel. Furthermore, the annular depression may be partially formed by the inner conductor element. Moreover, the annular depression may be round in shape as well as cornered in shape with straight or curved surfaces.

In a further embodiment, the outer conductor element, the inner conductor element, and the insulator element of the plug unit and/or the outer conductor element, the inner conductor element, and the insulator element of the mating plug unit are arranged coaxially with respect to one another and have a common central axis. It is particularly preferred here that the plug profile and/or the mating plug profile have a concentric shape and/or a radially symmetric shape with respect to the central axis.

FIG. 1 shows, in sectional view, a first embodiment of a connector assembly 1 according to the invention. The sectional plane extends along a longitudinal axis of connector assembly 1. Connector assembly 1 includes a plug unit 4 and a mating plug unit 5. Plug unit 4 is electrically conductively connected to a cable 2. In the present exemplary embodiment, cable 2 is a coaxial cable. Mating plug unit 5 is electrically conductively and permanently connected to an electrical component 3. In the present exemplary embodiment, electrical component 3 is also a coaxial cable. Plug unit 4 and mating plug unit 5 are each composed of an outer conductor element 6, 7, an insulator element 8, 9, and an inner conductor element 10, 11. Insulator elements 8, 9 each have an inner conductor channel 12, 13. Outer conductor elements 6, 7 are in the form of sleeves made of bronze, so that insulator elements, 8, 9 are fully disposed within outer conductor elements 6, 7. Insulator elements 8, 9 are made of plastic and have a cylindrical geometry. Inner conductor elements 10, 11, which are made of bronze, are each disposed in a respective inner conductor channel 12, 13 of insulator elements 8, 9. Outer conductor elements 6, 7 are each electrically conductively connected to a shield 27 and placed over a dielectric 29 of the respective cable 2, 3. Inner conductor elements 10, 11 are crimped to stranded conductors 28 of cables 2, 3. In the present embodiment, shield 27 is in the form of a wire mesh.

Plug unit 4 has a first plug end 14, and the mating plug unit 5 has a second plug end 19. Plug unit 4 and mating plug unit 5 are inserted into one another with the facing first and second plug ends 14, 19. In the region where plug unit 4 and mating plug unit 5 are inserted into one another, outer conductor element 6 of plug unit 4 has, to this end, an outer diameter that is smaller than the inner diameter of outer conductor element 7 of mating plug unit 5 in the same region. Furthermore, outer conductor element 7 of mating plug unit 5 has a contact spring for frictionally locking plug unit 4 in place and for creating a stable electrically conductive connection between the two outer conductor elements 6, 7. In the illustrated view, plug unit 4 and mating plug unit 5 are already inserted into one another. In the present exemplary embodiment, outer conductor elements 6, 7, insulator elements 8, 9, and inner conductor elements 10, 11 of plug unit 4 and mating plug unit 5 are arranged with their longitudinal axes on a common central axis 26.

Figure 2:
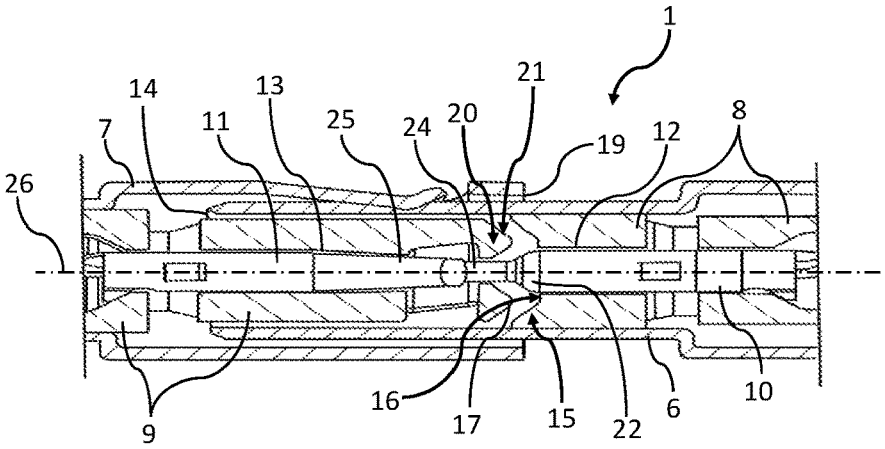
FIG. 2 is an enlarged sectional view of the first embodiment.

FIG. 2 shows the first embodiment of the inventive connector assembly 1 in an enlarged sectional view. Connector assembly 1 is in a plugged position, with plug unit 4 and mating plug unit 5 being positioned at the maximum possible distance from each other. This maximum possible distance may be due to, for example, tolerances of the individual components or a certain desired play between the components. Insulator element 8 of plug unit 4 has a plug profile 16 at end face at an end 15 facing toward the first plug end 14. In the present embodiment, plug profile 16 is formed, on the one hand, by a depression 18 adjacent the inner conductor channel 12 and extending annularly around the circumference of inner conductor channel 12. On the other hand, plug profile 16 is formed by a profiled portion 22 of inner conductor element 10. Insulator element 9 of mating plug unit 5 has a mating plug profile 21 at an end face of an end 20 facing toward second plug end 19. Mating plug profile 21 substantially corresponds to the negative of plug profile 16. For this purpose, insulator element 9 of mating plug unit 5 has, at its end face, a projection 17 extending annularly around inner conductor channel 13.

Inner conductor element 10 of plug unit 4 has a first contacting portion 24, which adjoins profiled portion 22 and is in the form of a contact tip. The contact tip projects from insulator element 8 of plug unit 4 toward first plug end 14. Furthermore, inner conductor element 10 tapers over profiled portion 22 toward contacting portion 24 to a smaller outside diameter. Inner conductor element 11 of mating plug unit 5 is set back from the end face at the end 20 of insulator element 9 that faces toward the second plug end 19, whereas inner conductor channel 13 extends up to the end face. Inner conductor element 11 of mating plug unit 5 has a second contacting portion 25, which is in the form of a contact socket. The contact socket has an inner diameter that is greater than the outer diameter of first contacting portion 24 of inner conductor element 10 of plug unit 4. In order to create an electrically conductive contact between contacting portions 24, 25, first contacting portion 24 is initially inserted into inner conductor channel 13 of mating plug unit 5. Subsequently, first contacting portion 24 enters into second contacting portion 25.

Figure 3:
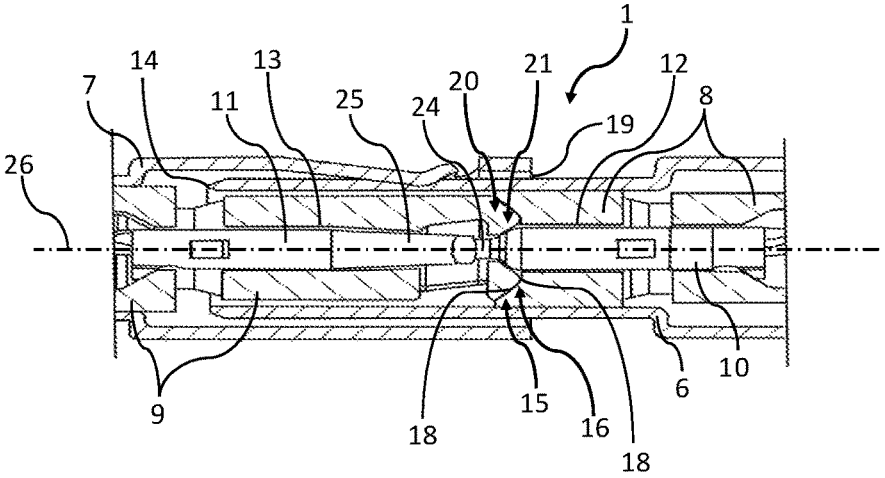
FIG. 3 is an enlarged sectional view showing the first embodiment in a plugged position.

FIG. 3 shows another sectional view of the first embodiment of the connector assembly 1 according to the invention. In the illustrated view, connector assembly 1 also in a plugged position, with plug unit 4 and mating plug unit 5 being positioned at the tolerance-related minimum possible distance from each other. First contacting portion 24 is electrically conductively connected to second contacting portion 25. In addition, plug profile 16 and mating plug profile 21 rest against each other. Thus, projection 17 of mating plug profile 21 conforms to the shape of depression 18 of plug profile 16. In profiled portion 22, inner conductor element 10 of plug unit 4 has a bulbous shape that tapers toward first contacting portion 24, so that profiled section 22 and depression 18 in insulator element 8 together have an annular depression which extends around the circumference of inner conductor element 10 and whose center is located on central axis 26.

Figure 4:
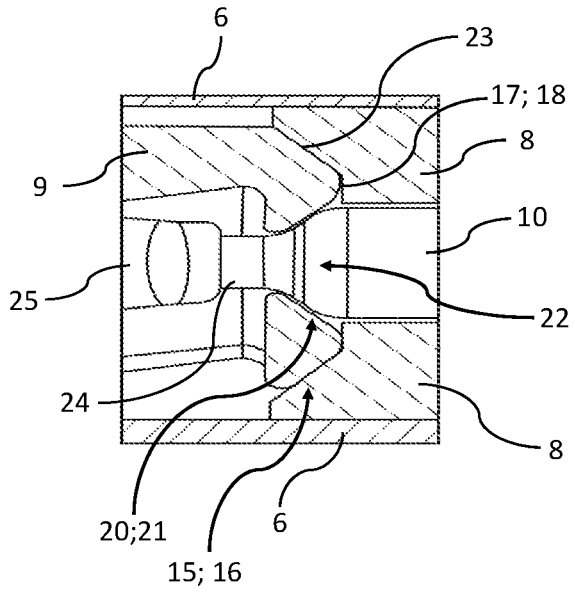
FIG. 4 is an enlarged view showing the first embodiment in the region of a plug profile in a plugged position.

FIG. 4 shows a further enlarged sectional view illustrating the first embodiment of the inventive connector assembly 1 in a plugged position in the region of plug profile 16 and mating plug profile 21. Mating plug profile 21 has a bevel 23 on an outer edge of the end 20 of insulator element 9 that faces toward second plug end 19, bevel 23 extending from an outer circumferential surface of insulator element 9 up to projection 18. Depression 18 of plug profile 16 has a complementary bevel 23. Due to the bevel 23 on both plug profile 16 and mating plug profile 21, the two insulator elements 8, 9 are guided together in such a way that the two insulator elements 8, 9 are located in a defined position relative to each other no later than when they reach the plugged position, even if they are inserted slightly obliquely into one another. Insulator element 9 of mating plug unit 5 has, at its end face, a funnel shape that extends around inner conductor channel 13. The funnel shape makes it possible to ensure, on the one hand, that mating plug profile 21 can at least partially form a negative of plug profile 16 also in the region of plug profile 16 that is formed by profiled portion 22 of inner conductor element 10. Owing to the funnel shape, it can also be ensured that as plug unit 4 and mating plug unit 5 are inserted into one another, inner conductor element 10 of plug unit 4 can be guided into inner conductor channel 13 of insulator element 9 of mating plug unit 5 without being damaged.

Figure 5:
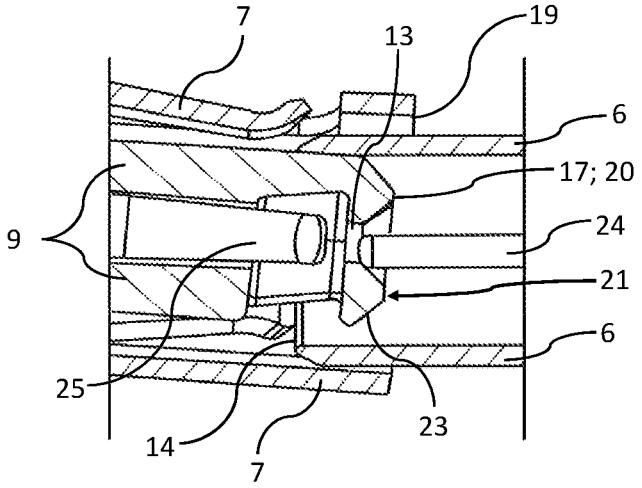
FIG. 5 is an enlarged view showing the first embodiment in the region of the mating plug profile during a plugging process.

FIG. 5 shows another sectional view of the first embodiment of the inventive connector assembly 1, illustrating the plugging process during which inner conductor element 10 of plug unit 4 is inserted into inner conductor channel 13 of insulator element 9 of mating plug unit 5. Although plug unit 4 and mating plug unit 5 are not inserted exactly parallel, but slightly obliquely into one another, first contacting portion 24 is guided into inner conductor channel 13 of insulator element 9 by the funnel shape. Thus, the risk of inner conductor element 10 of plug unit 4 being pressed against insulator element 9 of mating plug unit 5 or being deformed or even breaking off can be significantly reduced.

The explanations provided with regard to the figures are merely for the sake of illustration and are not to be construed as limiting.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 connector assembly
2 cable
3 component
4 plug unit
5 mating plug unit
6 outer conductor element of the plug unit
7 outer conductor element of the mating plug unit
8 insulator element of the plug unit
9 insulator element of the mating plug unit
10 inner conductor element of the plug unit
11 inner conductor element of the mating plug unit
12 inner conductor channel of the plug unit
13 inner conductor channel of the mating plug unit
14 first plug end
15 end of the insulator element of the plug unit
16 plug profile
17 projection
18 depression
19 second plug end
20 end of the insulator element of the mating plug unit
21 mating plug profile
22 profiled portion
23 bevel
24 first contacting portion
25 second contacting portion
26 central axis
27 shield
28 stranded conductor
29 dielectric

What is claimed is:

1. A connector assembly for connecting a cable to an electrical component, comprising:

a plug unit having a first plug end; and a mating plug unit having a second plug end, the mating plug unit being connectable to the plug unit, the plug unit and the mating plug unit each having an outer conductor element, an insulator element and an inner conductor element, wherein:

the insulator element is in each case disposed within the outer conductor element and includes an inner conductor channel in which the inner conductor element is disposed, the insulator element of the plug unit forms, at least partially, a plug profile at an end facing toward the first plug end, the plug profile extending at least partially around the inner conductor channel of the plug unit and having at least one projection and/or depression, the insulator element of the mating plug unit forms, at least partially, a mating plug profile at an end facing toward the second plug end, the mating plug profile at least partially corresponding to a negative of the plug profile, the plug profile is partially formed by the inner conductor element of the plug unit and/or the mating plug profile is at least partially formed by the inner conductor element of the mating plug unit, the plug unit and the mating plug unit are connectable to one another in such a way that the plug profile and the mating plug profile rest against each other, at least in some areas, wherein the part of the plug profile formed by the inner conductor element of the plug unit rests against the insulator element of the mating plug unit and/or the part of the mating plug profile formed by the inner conductor of the mating plug unit rests against the insulator element of the plug unit.

2. The connector assembly as recited in the claim 1, wherein the inner conductor element of the plug unit and/or of the mating plug unit have/has a profiled portion in a region of the plug profile and/or of the mating plug profile in which a profiled portion of the inner conductor element has a conical, parabolic and/or bulbous shape.

3. The connector assembly as recited in claim 1, wherein the plug profile and/or the mating plug profile have/has a bevel extending at least partially around a circumference of the inner conductor channel.

4. The connector assembly as recited in claim 1, wherein the inner conductor element of the plug unit includes a first contacting portion projecting from the insulator element of the plug unit toward the first plug end.

5. The connector assembly as recited in claim 4, wherein the first contacting portion is insertable into the inner conductor channel of the insulator element of the mating plug unit and electrically conductively connectable to a second contacting portion of the inner conductor element of the mating plug unit.

6. The connector assembly as recited in claim 1, wherein the inner conductor element of the mating plug unit is set back from the end of the insulator element facing toward the second plug end of the mating plug unit.

7. The connector assembly as recited in claim 1, wherein the insulator element of the mating plug unit has a funnel shape in a region of the inner conductor channel at the end facing toward the second plug end.

8. The connector assembly as recited in claim 7, wherein the funnel shape at least partially forms the mating plug profile.

9. The connector assembly as recited in claim 1, wherein the plug profile or the mating plug profile has an annular depression around a circumference of the inner conductor element.

10. The connector assembly as recited in claim 1, wherein the outer conductor element, the insulator element and the inner conductor element of the plug unit and/or the outer conductor element, the insulator element and the inner conductor element of the mating plug unit are arranged coaxially with respect to one another and have a common central axis.

11. The connector assembly as recited in claim 10, wherein the plug profile and/or the mating plug profile have/has a concentric shape and/or a radially symmetric shape with respect to the central axis.

12. The connector assembly as recited in claim 1, wherein the insulator element of the plug unit and the part of the plug profile formed by the inner conductor element of the plug unit together form an annular depression corresponding to an annular projection of the insulator element of the mating plug unit, or wherein the insulator element of the mating plug unit and the part of the mating plug profile formed by the inner conductor element of the mating plug unit together form an annular depression corresponding to an annular projection of the insulator element of the plug unit, wherein the annular depression and the annular projection contact each other in a plugged position of the connector assembly.

13. The connector assembly as recited in claim 12, wherein the insulator element of the plug unit or the mating plug unit has a bevel extending from an outer circumferential surface of the insulator element to the annular projection, and wherein the annular depression includes a corresponding bevel that is in contact with the bevel in the plugged position of the connector assembly.

* * * * *